United States Patent [19]

Martinez et al.

[11] 4,134,531

[45] Jan. 16, 1979

[54] SELF LOCKING OCTAGONAL BOX

[75] Inventors: David J. Martinez, Chicago; Joseph F. Schillinger, Palos Hills, both of Ill.

[73] Assignee: Champion International Corporation, Stamford, Conn.

[21] Appl. No.: 875,418

[22] Filed: Feb. 6, 1978

[51] Int. Cl.[2] ..... B65D 5/12

[52] U.S. Cl. ..... 229/23 BT; 229/45 R; 229/41 C

[58] Field of Search ..... 229/23 BT, 41 C, 43

[56] References Cited

U.S. PATENT DOCUMENTS

| | | | |
|---|---|---|---|
| 1,801,514 | 4/1931 | Magill | 229/45 X |
| 2,003,326 | 6/1935 | Wellman | 229/41 C UX |
| 2,073,272 | 3/1937 | Wellman | 229/45 |
| 2,412,798 | 12/1946 | Blackman | 229/45 |
| 2,692,722 | 10/1954 | Johnson | 229/45 |
| 2,858,968 | 11/1958 | Pellaton | 229/41 C X |
| 3,237,840 | 3/1966 | Keith | 229/41 C |
| 3,966,112 | 6/1976 | Gordon | 229/23 BT |

*Primary Examiner*—Davis T. Moorhead
*Attorney, Agent, or Firm*—Evelyn M. Sommer

[57] ABSTRACT

A self locking paperboard container comprises a tubular body portion and a corresponding cap member. The body portion has a sidewall including a plurality of upstanding panel members and a planar base portion which is enclosed by the upstanding panels. The body portion further includes a plurality of locking flaps which are disposed on the outer faces of alternate panel members. Each of the locking flaps extends from the free edge of its respective panel member to an intermediate portion thereof. In addition, each locking flap includes a camming surface. The cap member also has a sidewall which includes the plurality of upstanding panel members and a planar cover portion which is connected to one edge of each of the cap member panels. The cap member panels correspond in width and number to the panel members of the body portion. The cap member further includes a plurality of locking flaps which are disposed on the inner faces of alternate cap member panel members. Each of the cap member locking flaps extends from the free edge of its respective panel member to an intermediate portion thereof. In addition, each of the cap member locking flaps has a camming surface such that when the cap member is placed on the body portion with the cap member locking flaps opposing the body portion locking flaps the camming surfaces of the opposed locking flaps engage with each other and inhibit removal of the cap member from the body portion.

15 Claims, 7 Drawing Figures

SELF LOCKING OCTAGONAL BOX

BACKGROUND OF THE INVENTION

The subject invention relates to a new and improved paperboard container of the type that includes a tubular body portion and a corresponding cap member. The body portion and cap member of a typical container are each made from a single blank of paperboard which can be manufactured on conventional folding carton manufacturing equipment.

The type of containers to which the subject invention relates are typically used for packaging food products such as cheeses. It has been found, however, that known containers of this type have several shortcomings which relate to the relative ease with which the cap member can be removed from the body portion. More particularly, it has been found in practice that shoppers, especially children who accompany their parents to the supermarket, often remove the cover member of the container to examine the contents thereof, and then neglect to replace the cover. It can be appreciated that exposure of the food products to air for extended periods of time, not to mention exposure of the products to insects and the like, is quite undesirable. In addition, it can be appreciated that without a cover the chances that the food product will fall to the floor and thus be contaminated are very high.

Accordingly, it is an object of the subject invention to provide a paperboard container for containing food products which includes a tamperproof self locking cover. It is a further object of the subject invention to provide a self locking paperboard container which is simple and relatively inexpensive to manufacture.

SUMMARY OF THE INVENTION

In accordance with the subject invention, a self locking paperboard container comprises a tubular body portion having a sidewall which includes a plurality of upstanding, substantially rectangular panel members and a planar base portion, which is enclosed by the panel members. Preferably the base portion is octagonal in configuration, and the sidewall includes eight upstanding panels. The body portion also includes a plurality of locking flaps which are disposed on alternate panel members on the outer faces thereof. Each of the locking flaps extends from the free edge of its respective panel member to an intermediate portion thereof. In addition, each of the locking flaps includes a camming surface. The subject container further comprises a cap member having a sidewall which includes a plurality of upstanding, substantially rectangular panel members. The cap member panel members correspond in number and in width to the panel members of the body portion. The cap member also includes a planar cover portion which is connected to one edge of each of the cap member panel members. The cover portion is also preferably octagonal in configuration but has a larger plan area than the base of the body portion. Further, there should be enough panel members in the cap member and body portion and a loose enough fit between the cap and body such that the cap may be rotated relative to the body. The cap member further includes a plurality of locking flaps which are disposed on alternate cap panel members on the inner faces thereof. Each of the cap member locking flaps extends from the free edge of its respective cap member panel to an intermediate portion thereof. In addition, the cap member locking flaps each have a camming surface. When the cap member is placed onto the body portion such that the locking flaps of each oppose each other, the camming surfaces of each of the respective opposed locking flaps engage with each other to inhibit removal of the cap from the body portion. In order to remove the cap, the cap may be rotated such that the respective locking flaps of the cap member and body portion do not oppose each other and the camming surfaces of each do not engage. The cap may then be easily removed from the body portion.

DETAILED DESCRIPTION OF THE PREFERRED EMBODIMENT

Figure 1:
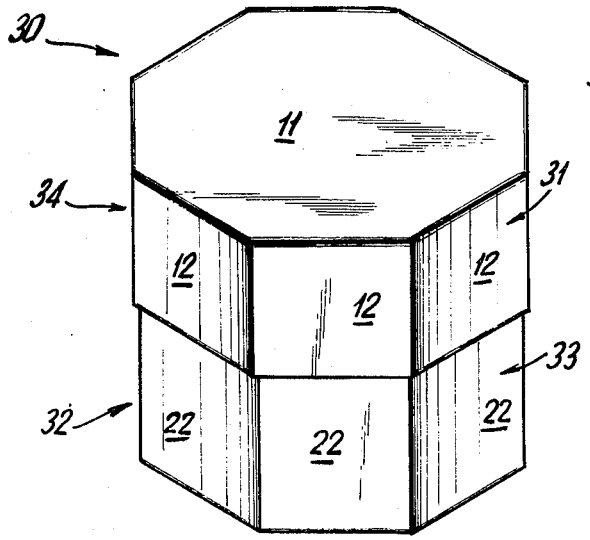
FIG. 1 is a perspective view of the container of the subject invention in which the cap member is attached to the body portion.
Figure 2:
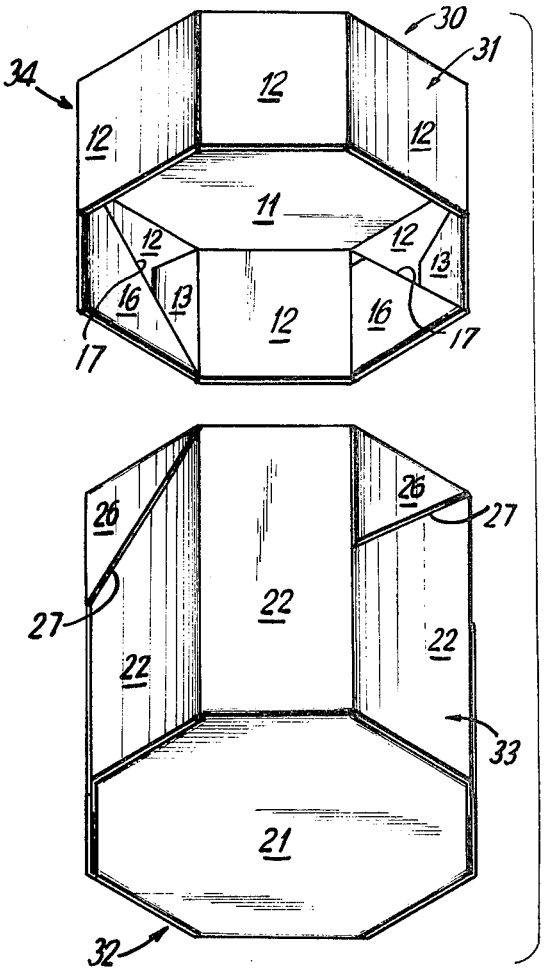
FIG. 2 is an exploded perspective view of the subject container showing the cap member detached from the body portion.

Referring to FIGS. 1 and 2, the container of the subject invention is designated by the numeral 30, and is preferably made of paperboard material. The paperboard material may have been waxed and/or provided with a plastic coating to protect the container from oils and moisture. The container 30 comprises a tubular body portion 32 and a corresponding cap member 34, each of which is preferably octagonal in configuration. The body portion and cap member are each formed from a single blank, 20 (FIG. 7) and 10 (FIG. 6) respectively, which is slotted and scored, as more fully described hereinafter. The body portion 32 includes an upstanding side wall 33 which is preferably of octagonal configuration and includes a plurality of upstanding, substantially rectangular panel members 22. The body portion also includes a planar base portion 21 which is also octagonal in configuration and is enclosed by panel members 22. Referring to FIGS. 2–5 the body portion 32 of the subject invention further includes a plurality of locking flaps 26 which are disposed on alternate panels 22 on the outer faces thereof. Each locking flap 26 extends from the free edge of its respective panel member to an intermediate portion thereof, and is preferably integral with and hingedly connected to the panel member. As illustrated in the drawings each locking flap 26 is folded against the outer face of its respective panel member and adhered thereto. It will be appreciated that instead of having a locking flap integral with the panel member a similar locking member may be simply adhered to a panel member without its having to be integral therewith and folded thereagainst. As further illustrated in the drawings each locking flap 26 is substantially triangular in configuration and has an angular camming surface 27, the function of which will be described below. Preferably each locking flap 26 is substantially a right triangle, the camming surface 27 being the hypotenuse of the triangle.

Figure 3:
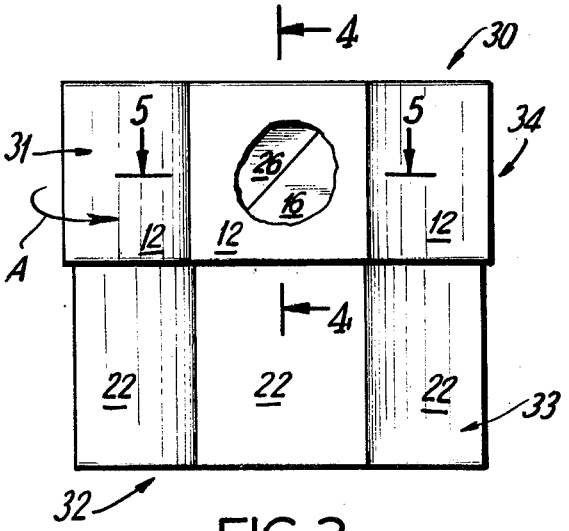
FIG. 3 is an elevational view of the container of the subject invention in which the cap member is attached to the body portion, with a portion of the cap member being cut away to show the engagement of a cap member locking flap with a body portion locking flap.
Figure 4:
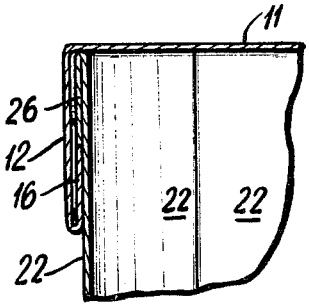
FIG. 4 is a partial cross-sectional view of the container of the subject invention taken along line 4—4 of FIG. 3.
Figure 5:
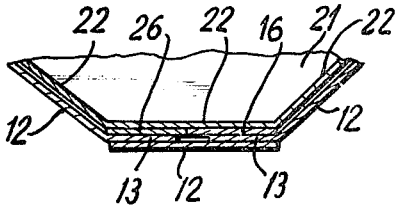
FIG. 5 is a partial sectional view taken along line 5—5 of FIG. 3.

Further referring to FIGS. 1–3 the cap member 34 of the subject invention includes an upstanding sidewall 31 which is preferably octagonal in configuration and includes a plurality of substantially rectangular panel members 12. The cap member panels 12 correspond in number and in width to the panel members 22 of body portion 32. The cap member 34 also includes a planar cover portion 11 which is octagonal in configuration. Each panel member 12 is hingedly connected to one edge of cover member 11. It should be noted that cover portion 11 has a greater plan area than base portion 21 so as to permit cap member 34 to fit over body portion 32. In addition, the cap member 34 and body portion 32 must each have enough panel members, and the fit between the cap member and body portion must be loose enough to enable the cap member to be rotated relative to the body portion. However, the number of panels and the looseness of fit should not be such that the cap is easily rotatable relative to the body portion. The purpose of this rotatability will be described below.

Cap member 34 further includes a plurality of locking flaps 16 which are disposed on alternate panels 12 on the inner faces thereof. Each locking flap 16 extends from the free edge of its respective panel member 12 to an intermediate portion thereof, and is preferably integral with and hingedly connected to the panel member. As illustrated in the drawings each locking flap 16 is folded against the inner face of its respective panel member. As further illustrated in the drawings each locking flap 16 is substantially triangular in configuration and has an angular camming surface 17. Preferably each locking flap 16 is substantially a right triangle, the camming surface 17 being the hypotenuse of the triangle.

Figure 6:
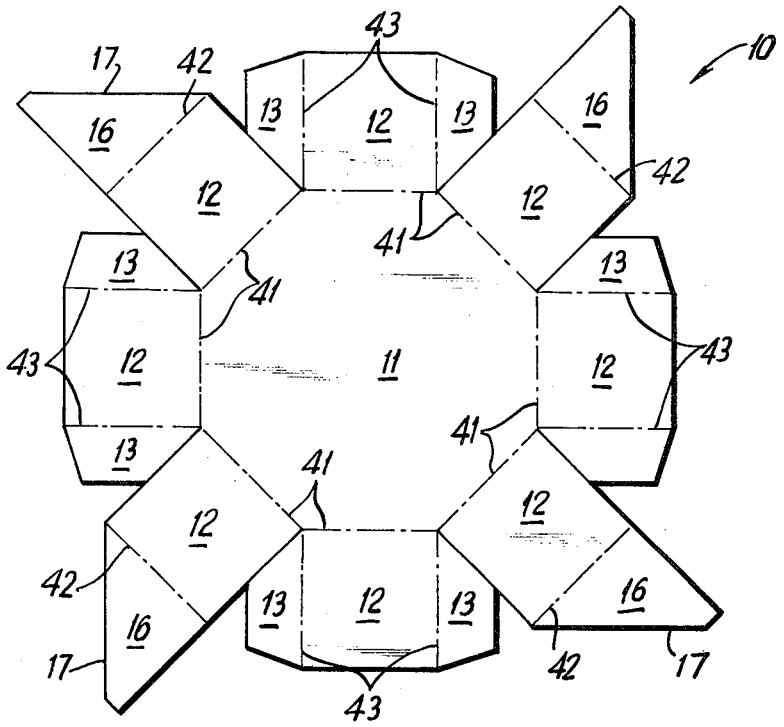
FIG. 6 is a plan view of the blank for forming the cap member of the container of the subject invention.
Figure 7:
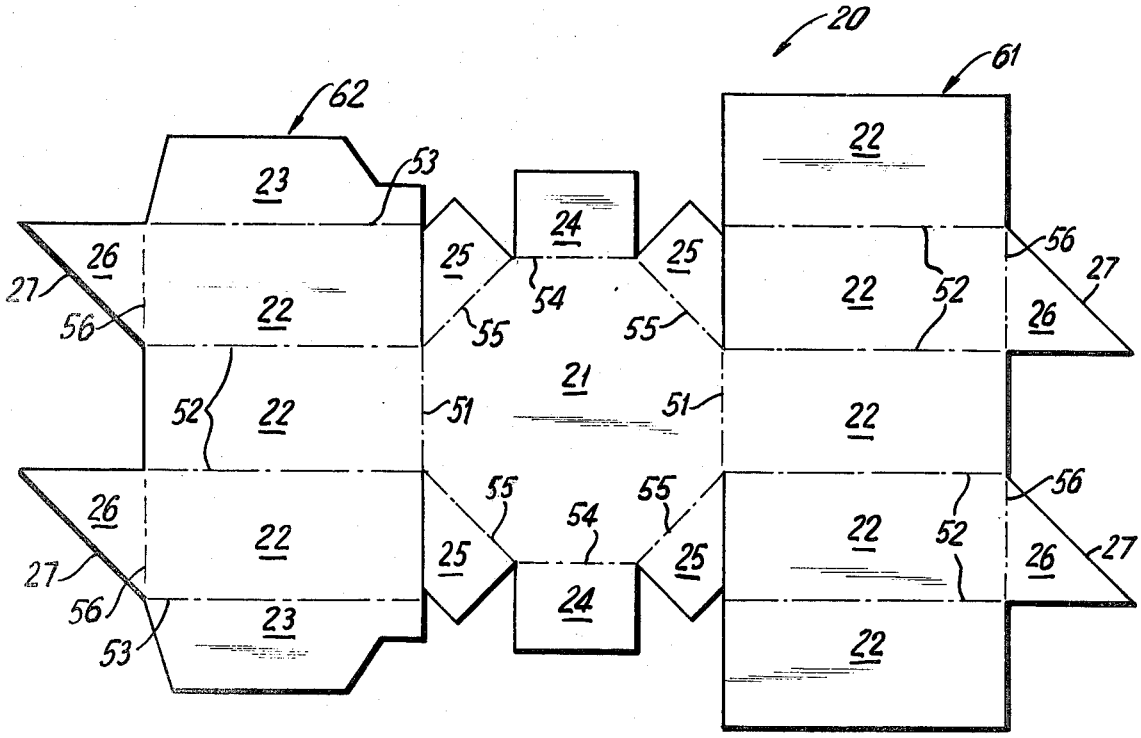
FIG. 7 is a plan view of the blank for forming the body portion of the container of the subject invention.

Referring to FIG. 7, the blank 20 for forming the body portion of the subject invention is a single sheet of paperboard that has been appropriately slotted and scored. More particularly, the blank 20 includes a central base portion 21 which is preferably octagonal in configuration. A pair of major base glue flaps 24 are hingedly connected to opposite edges of base portion 21 along fold lines 54. Similarly, minor base glue flaps 25 are hingedly connected to alternate edges of base portion 21 along score lines 55. In the preferred embodiment of the subject invention blank 20 further includes a first and second strip of panels 61 and 62 respectively, each strip having a plurality of substantially rectangular panel members 22. Each strip 61 and 62 is hingedly connected to an opposed edge of base portion 21 along score lines 51. In addition, the panels 22 of each strip are hingedly connected to each other along score lines 52. Further, a pair of side glue flaps 23 are hingedly connected to the ends of panel strip 62 along score lines 53. Still further, the blank 20 includes a plurality of locking flaps 26 which are hingedly connected to alternate panels 22 along score lines 56. More particularly, as illustrated in FIG. 6, blank 20 includes a first pair of locking flaps 26 hingedly connected to alternate panels 22 of strip 62, and a second pair of locking flaps 26 which are hingedly connected to alternate panels 22 of strip 61. As further illustrated in FIG. 6 locking flaps 26 are preferably right triangles in configuration. It should be noted that locking flaps 26 of strip 62, while being aligned with each other, are disposed opposite to the locking flaps 26 of strip 61; the flaps 26 of strip 61 being aligned with each other. In constructing body portion 32 of FIGS. 1–3, blank 20 is folded along its score lines and the various glue flaps adhered to their respective panel members. In addition, locking flaps 26 are outwardly folded along and adhered to the outer face of their respective panel members.

Referring now to FIG. 6, the cap members 34 of the subject invention is constructed from a single paperboard blank 10. Blank 10 comprises a central cover portion 11 which is preferably octagonal in configuration, and slightly larger in plan area than base portion 21 of body portion 32. Hingedly connected to body cover portion 11 along hinge lines 41 are a plurality of side panels 12 which make up the sidewall 31 of the cap member. A pair of glue flaps 13 is hingedly connected to alternate side panels 12 along fold lines 43. In addition, blank 10 includes a plurality of locking flaps 16 which are disposed on alternate side panels 12, each of said locking flaps 16 preferably being integral with and hingedly connected to its respective side panel along a fold line 42. In constructing the cap member 34 the side panels 12 are folded up along fold lines 41 and each of the glue flaps 13 appropriately adhered to the side panel 12 immediately adjacent thereto. In addition, each of the locking flaps 16 is inwardly folded along a fold line 42 against the inner face of its respective side panel 12. It should be noted that each locking flap 16 includes an angular camming surface 17.

In operation, cover member 34 is placed over the body portion 32 such that the respective side panels of each overlie each other. If it is desired to lock the cover member onto the body portion the cover member is placed over the body portion such that each locking flap 16 on the inner surface of the cover portion is aligned with a corresponding locking flap 26 on the outer surface of the body portion. As is apparent from FIG. 3 when the cover member 34 is placed over the body portion 32 in the locked position the camming surfaces of the respective cover member locking flaps and base portion locking flaps, 16 and 26 respectively, engage with each other such that each body portion locking flap 26 overlies a cover member locking flap 16. Because of this relationship in which the base portion locking flaps 26 overlie the cover portion locking flaps 16 removal of the cover member 32 from the body portion 34 is inhibited. (See also FIGS. 4 and 5.) As further illustrated in FIG. 3 in order to remove the cover member 34 from the body portion 32 it is necessary to rotate the cover portion 32 such that the respective engaging locking flaps of the cover member and the body portion are separated from each other. Arrow A of FIG. 3 illustrates the direction of rotation of cover member 34. In this arrangement the camming surfaces of the respective locking flaps are no longer engaged and the cover member may be pulled off and easily removed from the body portion.

In summary, the subject invention provides a new and improved paperboard container for storage of food products such as cheeses and the like. When the cover member is appropriately placed over the body portion a locking mechanism inhibits removal of the cover from the body. By appropriate rotation of the cover member the locking mechanism disengages, allowing the removal of the cover from the body portion. It can be appreciated that the subject container significantly cuts down on the contamination and waste of food products which often results from tampering with known containers by children. Not only does the subject container provide effective tamperproof features, but said features are accomplished by very simple and inexpensive means.

While the preferred embodiment of the subject invention has been described and illustrated, it would be obvious that various changes and modifications can be made therein without departing from the spirit of the invention which should be limited only by the scope of the appended claims.

What is claimed is:

1. A self locking paperboard container comprising:

a tubular body portion having a sidewall including a plurality of upstanding panel members and a planar base portion, said body portion including a plurality of locking flaps disposed on alternate upstanding panel members on the outer faces thereof, each of said locking flaps extending from the free edge of its respective panel member to an intermediate portion thereof, each of said locking flaps including a camming surface; and a cap member having a sidewall including a plurality of upstanding panel members and a planar cover portion said cover portion being slightly larger in plan area than the base portion, said cap member panel members corresponding in width and number to the panel members of said body portion, said cap member further including a plurality of locking flaps disposed on alternate cap member panel members on the inner faces of said cap member panel members, each of said cap member locking flaps extending from the free edge of its respective cap member panel to an intermediate portion thereof, said cap member locking flaps each having a camming surface such that when the cap member is placed on said body portion with the locking flaps of the cap member opposing the locking flaps of the body portion the camming surfaces of said opposed locking flaps engage each other and inhibit removal of the cap member from the body portion, there being a sufficient number of panel members in said body portion and cap member, and the fit between said body portion and cap member being such that said cap member is resistively rotatable relative to said body portion.

2. A self locking paperboard container as recited in claim 1 in which the body portion and the cap member are octagonal in configuration.

3. A self locking paperboard container as recited in claim 1 in which each of the locking flaps of the body portion is integral with its respective side panel.

4. A self locking paperboard container as recited in claim 1 in which each of the locking flaps of the cap member is integral with its respective side panel.

5. A self locking paperboard container which the locking flaps of the cap member and of the body portion are substantially triangular in configuration.

6. A self locking paperboard container as recited in claim 5 in which the locking flaps are substantially right triangles and the hypotenuse of each triangle is its camming surface.

7. A self locking paperboard container as recited in claim 1 in which the paperboard is waxed.

8. A self locking paperboard container as recited in claim 1 in which the paperboard is provided with a plastic covering.

9. A self locking paperboard container as recited in claim 1 which each of the panel members of the body portion and the cap member are substantially rectangular in configuration.

10. A self locking paperboard container comprising:

a tubular body portion of substantially octagonal configuration having a sidewall including a plurality of upstanding substantially panel members and a planar octagonal base portion, said body portion including a plurality of substantially right triangular locking flaps, each of said locking flaps being integral with and folded against the outer face of alternate upstanding panel members, each of said locking flaps extending from the free edge of its respective panel member to an intermediate portion thereof, the hypotenuse of each of said locking flaps being a camming surface; and a substantially octagonal cap member having a sidewall including a plurality of upstanding substantially rectangular panel members and an octagonal planar cover portion, said cover portion being slightly larger in plan area than the base portion of said body portion, such that the cap member is resistively rotatable relative to said body portion, said cap member panel members corresponding in width and number to the panel members of said body portion, said cap member further including a plurality of substantially right triangular locking flaps which are integral with and folded against the inner faces of alternate cap member panel members, each of said cap member locking flaps extending to its respective cap member panel to an intermediate portion thereof, the hypotenuse of each cap member locking flap being a camming surface such that when the cap member is placed on said body portion with the locking flaps of the cap member opposing the locking flaps of the body portion the respective camming surfaces of said opposed locking flaps engage each other and inhibit removal of the cap member from the body portion.

11. A pair of blanks for forming a self locking paperboard container having a tubular body portion and a corresponding cap member comprising:

a first blank for forming said body portion, said blank including a central, octagonal base portion; a plurality of base glue flaps hingedly connected to said base portion; first and second strips of panel members hingedly connected to opposed edges of said base portion, each of said strips having a plurality of hingedly connected, substantially rectangular panel members; a side glue flap hingedly connected to each end of said first strip of panel members; a first pair of substantially triangular locking flaps, said locking flaps being hingedly connected to alternate panels on said first strip, said locking flaps being aligned with each other; a second pair of substantially triangular locking flaps, hingedly connected to alternate panels on said second strip, said alternate panels on said second strip being opposed to the panels of the first strip to which said first pair of locking flaps are connected, said second pair of locking flaps being aligned with each other and disposed opposite to said first pair of locking flaps; and a second blank for forming said cap member including a central, octagonal cover portion, said cover portion having a larger plan then the base portion of said body portion; a plurality of panel members, each of said panel members being hingedly connected to an edge of said cover portion; a substantially triangular locking flap hingedly connected to each of the side panels along the edge of said side panel opposite the edge of said cover portion and a glue flap hingedly connected to either side of the remaining side panels.

12. A pair of blanks for forming a self locking paperboard container as recited in claim 11 in which the locking flaps on said first blank and the locking flaps on said second blank are substantially right triangles.

13. A pair of blanks for forming a self locking paperboard container as recited in claim 11 in which the panel members of said second blank have substantially the same width as the panel members on said first blank.

14. A pair of blanks for forming a self locking paperboard container as recited in claim 11 in which said first and second blanks are waxed.

15. A pair of blanks for forming a self locking paperboard container as recited in claim 11 in which said first and second blanks are provided with a plastic coating or at least one side thereof.

* * * * *